US007656093B2

(12) United States Patent
Kumada

(10) Patent No.: US 7,656,093 B2
(45) Date of Patent: Feb. 2, 2010

(54) DISCHARGE LAMP AND METAL FOIL FOR A DISCHARGE LAMP

(75) Inventor: Toyohiko Kumada, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 248 days.

(21) Appl. No.: 11/757,052

(22) Filed: Jun. 1, 2007

(65) Prior Publication Data

US 2007/0285014 A1 Dec. 13, 2007

(30) Foreign Application Priority Data

Jun. 8, 2006 (JP) ..... 2006-159932

(51) Int. Cl.
*H01J 17/18* (2006.01)

(52) U.S. Cl. ..... 313/623; 313/331

(58) Field of Classification Search ..... 313/624–643, 313/567, 623, 331
See application file for complete search history.

(56) References Cited

U.S. PATENT DOCUMENTS

| | | | | |
|---|---|---|---|---|
| 5,109,181 | A | 4/1992 | Fischer et al. | |
| 5,497,049 | A | 3/1996 | Fischer | |
| 6,653,785 | B2 | 11/2003 | Takagaki et al. | |
| 6,861,806 | B2 | 3/2005 | Kumada et al. | |
| 6,903,509 | B2 | 6/2005 | Kanzaki | |
| 2003/0168981 | A1* | 9/2003 | Kanzaki | 313/631 |
| 2006/0148367 | A1* | 7/2006 | Ogino et al. | 445/26 |
| 2006/0197475 | A1* | 9/2006 | Yamamoto et al. | 315/330 |
| 2007/0013288 | A1 | 1/2007 | Tanba et al. | |

FOREIGN PATENT DOCUMENTS

| | | |
|---|---|---|
| EP | 1 708 246 A2 | 10/2006 |
| JP | 1-169837 A | 7/1989 |

* cited by examiner

*Primary Examiner*—Joseph L Williams
*Assistant Examiner*—Brenitra M Lee
(74) *Attorney, Agent, or Firm*—David S. Safran; Roberts Mlotkowski Safran & Cole, P.C.

(57) ABSTRACT

An ultra high pressure mercury lamp having a light emitting part, a pair of electrodes; hermetically sealed portions; part of the electrodes and metal foils installed in the hermetically sealed portions and connected to the base parts of the electrodes; and outer leads connected to the base parts of the metal foils. The metal foils have a region with a small width which is groove-shaped and with which the electrodes are connected, and a wide region which borders the region with a small width, and which has an Ω-shaped end region which borders the groove of the region with a small width, in which an end groove is formed, and which extends in the lengthwise direction, a base-side Ω-region which is connected to the outer lead, in which a base-side groove is formed, and a middle, flat region which extends between the end Ω-region and the base-side Ω-region.

4 Claims, 7 Drawing Sheets

DISCHARGE LAMP AND METAL FOIL FOR A DISCHARGE LAMP

BACKGROUND OF THE INVENTION

1. Field of the Invention

The invention relates to a discharge lamp. The invention relates especially to a discharge lamp which is used as back light of a projection type projector device such as a liquid crystal display device, DLP® (digital light processor) (registered mark) using a DMD® (digital micromirror device) (registered mark) or the like.

2. Description of Related Art

In a projection type projector device, there is a demand for illumination of images onto a rectangular screen, uniformly, and moreover, with adequate color rendering. Therefore, it has been proposed that the light source be an ultra high pressure mercury lamp in which the mercury vapor pressure during operation is at least 150 atm. Such an ultra high pressure mercury lamp is described in Japanese Patent Application JP-A-2-148561 which corresponds to U.S. Pat. No. 5,109,181 and Japanese Patent Application JP-A-6-528301 which corresponds to U.S. Pat. No. 5,497,049.

FIG. 1 schematically shows the arrangement of the ultra high pressure mercury lamp. In the figure, an ultra high pressure mercury lamp 1 has an essentially spherical light emitting part 10 and cylindrical hermetically sealed portions 12 which border the two ends of the light emitting part 10 which is, for example, a silica glass bulb 11. The interior S of the light emitting part 11 is filled with at least 0.15 mg/mm$^3$ of mercury and a halogen gas as the emission substances for carrying out the halogen cycle. In the interior S, the ends of the electrodes 2, 3 are disposed opposite each other. Metal foils 4 for power supply are inserted into the hermetically sealed portions 12; the ends of the foils are connected to the base parts of the electrodes 2, 3. Outer leads 5 which project to the outside from the hermetically sealed portions 12 are connected to the base parts of the metal foils 4.

In the ultra high pressure mercury lamp, since the pressure of the interior S is extremely high in operation, it is necessary to connect the silica glass comprising the hermetically sealed portions 12, the electrodes 2, 3 and the metal foils 4 for power supply securely to one another in the hermetically sealed portions 12 which border the two ends of the light emitting part 10. The reason for this is that a poor adhesive property leads to escape of the added gases or to crack formation. In the process of hermetic sealing of the hermetically sealed portions, for example, the silica glass is heated at a high temperature of 2000° C., and in this state, the tough silica glass is gradually contracted and the adhesive property of the hermetically sealed portions is improved.

However, if the silica glass is heated to an overly high temperature, the adhesive property of the silica glass with the electrodes 2, 3 or the metal foils 4 is increased. However, it was regarded as disadvantageous that, after completion of an ultra high pressure mercury lamp, the hermetically sealed portions 12 can be easily damaged.

This disadvantage is based on the fact that, in the stage of gradual temperature decrease of the hermetically sealed portions after heat treatment, due to the different coefficients of expansion between the tungsten comprising the electrodes 2, 3 and the silica glass comprising the hermetically sealed portions 12, the relative amounts of expansion differ; this causes crack formation in their contact regions. It can be imagined that these cracks are extremely small, but cause crack growth, the ultra high pressure state in lamp operation also playing a part, and that they cause damage to the ultra high pressure mercury lamp.

According to Japanese Patent Application JP-B-3670414 and corresponding U.S. Pat. No. 6,903,509, the above described crack formation is caused by a gap which inevitably forms in the region in which the metal foil is welded to the electrode in the hermetically sealed portion. Furthermore, Japanese Patent Application JP-B-3670414 and corresponding U.S. Pat. No. 6,903,509 describe that, by the area of the respective metal foil which is connected to the respective electrode having a smaller width than the width in the remaining area of the metal foil, the area with the smaller width wrapping at least partially around the outside surface of the electrode, the above described gap formation is avoided, and that, in this way, crack formation can be prevented, as is shown in FIGS. 8(*a*) to 8(*c*).

FIGS. 8(*a*) to 8(*c*) are schematics of an electrode-mount assembly and of the metal foil of the conventional ultra high pressure mercury lamp. FIG. 8(*a*) shows the electrode end mount assembly in a front view. FIG. 8(*b*) shows a view in which the metal foil is viewed from overhead. FIG. 8(*c*) are cross sections taken along lines A-A and B-B in FIG. 8(*b*).

In FIGS. 8(*a*) to 8(*c*), the metal foil 4' has a region 41' with a small width with a groove-like overall shape which is connected to the base part 22A' of the upholding part of the electrode 22' and a wide region 42' with a cross section in the direction of width which is formed to be Ω-shaped by formation of a groove part 46' with a width and depth which are uniform over the entire length, and which borders the region 41' with a small width. Because the electrode end mount assembly 20' which has been produced by connecting the outer lead 5' and the base part 22A' of the upholding part of the electrode 22' with such a metal foil 4' is inserted and hermetically sealed in a silica glass tube which constitutes the bulb, an unwanted gap is reliably prevented from being formed between the base part 22A' of the upholding part of the electrode 22' and the metal foil 4'. This should mean that crack formation in the hermetically sealed portion is thus prevented.

However, crack formation in the hermetically sealed portion could not be completely prevented by the technology described in Japanese Patent Application JP-B-3670414 and corresponding U.S. Pat. No. 6,903,509 for the reason described below.

FIGS. 9(*a*) to 9(*c*) show schematics describing the disadvantage in production of an ultra high pressure mercury lamp using the electrode end mount assembly 20' which had been produced according to FIGS. 8(*a*) to 8(*c*). In FIGS. 9(*a*) to 9(*c*), the silica glass tube 10' is omitted on the side into which the electrode end mount assembly 20' is not inserted.

As shown in FIG. 9(*a*), for the electrode end mount assembly 20', the upholding part of the electrode 22' and the component 50' for the outer lead are connected to the metal foil 4'. On the base side of the component 50' for the outer lead, an elastic connection strip R' is attached. When this electrode end mount assembly 20' is inserted into the silica glass tube 10', due to factors such as the skill of the operator and the like, there are cases in which the electrode end mount assembly 20' is arranged inclined with respect to the center axis of the silica glass tube 10', as shown in FIG. 9(*a*). In this case, the upholding part of the electrode 22' is arranged eccentrically from the center axis of the silica glass tube 10'.

In this state, if a shrink seal is attempted in which, for example, the glass is heated from the outside of the silica glass tube 10', for example, by means of a burner or the like, in order to allow the upholding part of the electrode 22' and the metal foil 4' which has been inserted into the silica glass tube 10' to adhere hermetically to the glass, as is shown in FIG. 9(*b*), as is described below, cracks form in the silica glass of the hermetically sealed portion.

In shrink sealing, since the heating force of the burner and the burn time are fixed under certain conditions, the glass is uniformly contracted in the direction to the center axis of the silica glass tube 10'. In shrink sealing, a force is applied for moving the upholding part of the electrode 22' in the direction to the center axis of the silica glass tube 10' when the molten glass reaches the surface 22X of the upholding part of the electrode 22' on the side which is adjacent to the inside wall of the silica glass tube 10'.

In the component 50' of the outer lead, movement in the direction which orthogonally intersects the center axis is controlled by the elasticity of the connection strip R'. The cross section of the wide part 42' of the metal foil 4' is made Ω-like over the entire length by the component arrangement shown above using FIGS. 8(*a*) to 8(*c*). The bending strength of the wide part 42' is high. Therefore, since the above described force for moving the upholding part of the electrode 22 in the direction toward the center axis of the silica glass tube 10' is concentrated on the region with a small width 41' in which the bending strength is weakest and which is not connected to the base part 22A' of the upholding part of the electrode 22', the region with a small width 41' of the metal foil 4' bends to a great extent, as is shown in FIG. 9(*b*). The adhesive property of the bent region of the metal foil 4' on the glass is thus weakened. Thus, in operation of the completed ultra high pressure mercury lamp shown in FIG. 9(*c*), cracks form by application of a mercury vapor pressure in the interior S on the hermetically sealed portion 12'.

When the outside diameter of the base part 22A' of the upholding part of the electrode 22' differs from the outside diameter of the outer lead 5', the following disadvantages arise when the electrode mount assembly 20' is produced using the metal foil 4' in which the width and depth of the groove 46' correspond to FIGS. 8(*a*) to 8(*c*).

It is necessary to fix the width and depth of the groove 46' according to the outside diameter of the outer lead 5' or the outside diameter of the upholding part of the electrode 22'. However, since normally the outer lead 5' is thicker than the upholding part of the electrode 22', in the case of construction of the width and depth of the groove 46' according to the outside diameter of the upholding part of the electrode 22', the outer lead 5' cannot be accommodated in the groove 46'. If the attempt is made to accommodate the outer lead 5' in the groove 46' with such a construction by force, there is the danger that the metal foil 4' will be damaged.

In the case of construction of the width and depth of the groove 46'corresponding to the outside diameter of the outer lead 5' which is thicker than the upholding part of the electrode 22', both the upholding part of the electrode 22' and also the outer lead 5' which is held in the groove 46' can be connected to the groove 46'. However, in the electrode mount assembly 20', the center axis of the upholding part of the electrode 22' does not agree with the center axis of the outer lead 5', by which the upholding part of the electrode 22' deviates eccentrically from the outer lead 5'.

In this state, in which the upholding part of the electrode 22' deviates eccentrically from the outer lead 5' which is being inserted into the silica glass tube 10' with the electrode mount assembly 20' which is connected to the metal foil 4', since the inside diameter of the silica glass tube 10 is constructed according to the outside diameter of the outer lead 5' with a large diameter, the upholding part of the electrode 22 is in the state in which it deviates eccentrically from the center axis of the silica glass tube 10', as is shown in FIG. 10(*a*). In this state, when shrink sealing is performed, as was described above, based on the Ω-shaped execution of the cross section of the wide region 42' of the metal foil 4' over the entire length, the above described force for moving the upholding part of the electrode 22' in the direction of the center axis of the silica glass tube 10' is concentrated on the region with the small width 41' with an extremely low bending strength. As a result, the region with a small width 41 of the metal foil 4' bends greatly, as is shown in FIG. 10(*b*). The adhesive property of the bending site of the metal foil 4' on the glass is weakened. Thus, the disadvantage arises that, by applying a high mercury vapor pressure of the interior S in operation, cracks form in the hermetically sealed portion 12'.

As was described above, in a conventional ultra high pressure mercury lamp, it is regarded as disadvantageous that, by bending the region 41' of the metal foil 4' with a small width, the adhesive property of the region 41' with a small width near the interior S of the ultra high pressure mercury lamp on the glass in the vicinity is adversely affected, by which cracks form in the hermetically sealed portion 12'.

SUMMARY OF THE INVENTION

Therefore, a primary object of the present invention is to prevent bending of the region with a small width of the metal foil and to reliably prevent crack formation in the silica glass of the hermetically sealed portion.

The above described object is achieved in accordance with the invention in a discharge lamp which comprises the following:

- a light emitting part in which there is a pair of opposed electrodes;
- hermetically sealed portions which border opposite ends of the light emitting part and hermetically seal a part of the electrodes;
- metal foils which are installed in the hermetically sealed portions and which have ends which are connected to the base parts of the electrodes;
- outer leads with ends connected to the base parts of the metal foils and with base parts projecting to the outside from the hermetically sealed portions, in that each of the above described metal foils has a region with a small width which has a groove-like overall shape and with which the above described electrodes are connected, and of a wide region, which borders the region with a small width, and that has an end Ω-region, which borders the groove of the region with a small width, in which an end groove is formed, and which extends in the lengthwise direction, a base-side Ω-region which is connected to the outer lead, in which a base-side groove is formed, and which extends in the lengthwise direction, and a middle, flat region which extends between the end Ω-region and the base-side Ω-region in the lengthwise direction.

Furthermore, the object is achieved in accordance with the invention in that the outside diameter of the electrode and the outside diameter of the outer lead differ from one another, that the end groove and the base-side groove, according to the outside diameter of the base part of the electrode and the outside diameter of the outer lead, have a respective width and a respective depth and that the center axis of the base part of the electrode and the center axis of the outer lead agree with one another in the state connected to the metal foil.

Additionally, the object is achieved in accordance with the invention in that the outside diameter of the outer lead is larger than the outside diameter of the base part of the electrode.

The object is also achieved in accordance with the invention in a metal foil for a discharge lamp in that the foil has a region with a small width with a groove-like overall shape and of a wide region. which borders the region with a small width, that has an end Ω-shaped region which borders the groove of the region with a small width, in which an end groove is formed, and which extends in the lengthwise direction, a base-side Ω-region in which a base-side groove is formed and which extends in the lengthwise direction, and a middle, flat region which extends between the end Ω-shaped region and the base-side Ω-shaped region in the lengthwise direction.

ACTION OF THE INVENTION

The discharge lamp in accordance with the invention prevents bending of the metal foil in the region with the small width, even with an eccentric arrangement of the electrode relative to the center axis of the silica glass tube, by which formation of cracks in the silica glass of the hermetically sealed portion can suppressed.

The invention is further described below with reference to the accompanying drawings.

DETAILED DESCRIPTION OF THE INVENTION

First Embodiment

Figure 1:
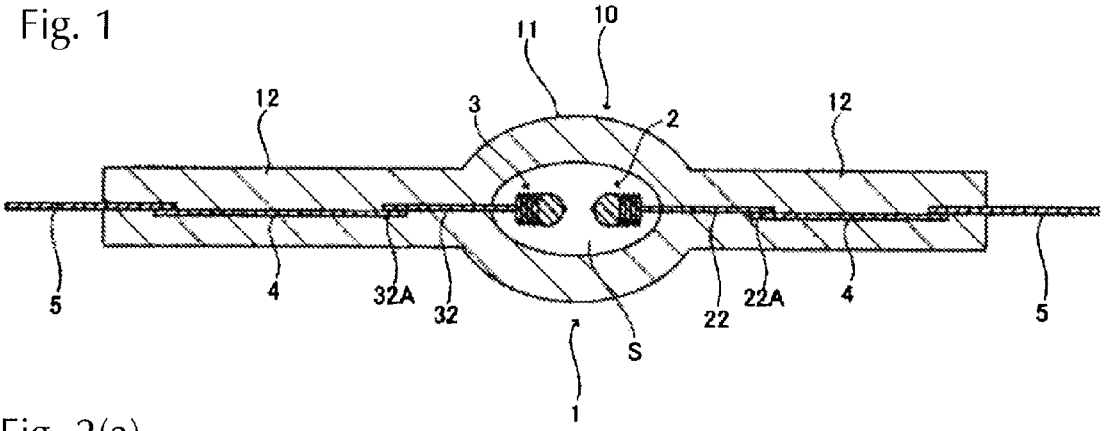
FIG. 1 is a schematic lengthwise cross-sectional view of the arrangement of an ultra high pressure mercury lamp.

FIG. 1 is a schematic cross section of the arrangement of an ultra high pressure mercury lamp in accordance with the invention in the lengthwise direction. The ultra high pressure mercury lamp 1 has a bulb 10 with an essentially spherical light emitting part 11 with an interior S and cylindrical hermetically sealed portions 12 which border the two ends of the light emitting part 11 and which extend in the lengthwise direction. The bulb 10 is made of a transparent material, such as silica glass or the like. In the interior S, there is a pair of opposed electrodes 2, 3 that are made of tungsten and it is also filled with mercury as the emission substance, halogen gas for carrying out the halogen cycle, such as, for example, bromine gas or the like, and for example, argon gas as a buffer gas.

The amount of mercury added is at least 0.15 mg/mm$^3$ so that the mercury vapor pressure in the interior S during operation is at least 150 atm. However, an amount of added mercury of at least 0.2 mg/mm$^3$ is especially advantageous since it enables an ultra high pressure mercury lamp with a high mercury vapor pressure to be produced. The amount of the halogen gas added is in the range from $3.0\times10^{-4}$ μmol/mm$^3$ to $7.0\times10^{-3}$ μmol/mm$^3$. The amount of added buffer gas is in the range from 10 kPa to 20 kPa.

In each hermetically sealed portion 12, a metal foil 4 of molybdenum is hermetically installed by shrink sealing for purposes of power supply. Base parts 22A, 32A of the upholding part of the electrode 22, 32 are connected to the ends of the metal foils 4. The end of the outer lead 5 for power supply is connected to the base part of the metal foil 4. The base part of the outer lead 5 projects to the outside from the hermetically sealed portion 12.

Such an ultra high pressure mercury lamp is operated using an alternating current which supplies the electrodes 2, 3 with current from an alternating current source (not shown) and which is connected to the outer leads 5. A high voltage is applied between the electrodes 2 and 3 by the alternating current source. An insulation breakdown forms between the electrodes 2, 3. Light which contains wavelengths of visible radiation of 360 nm to 780 nm is emitted from the light emitting part 11.

Figure 2A:
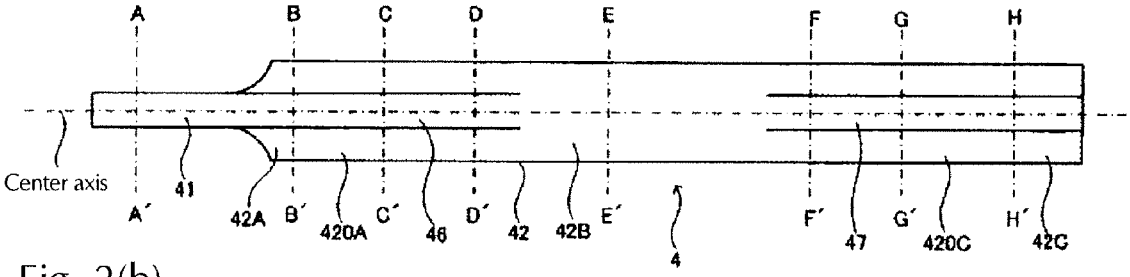
FIGS. 2(*a*) to 2(*c*) each show a schematic of the metal foil according to a first embodiment of the invention, FIG. 2(*a*) being a plan view, FIG. 2(*b*) being a longitudinal sectional view and FIG. 2(*c*) being cross-sectional views taken along lines A-A' to H-H' in FIG. 2(*a*)
Figure 2B:
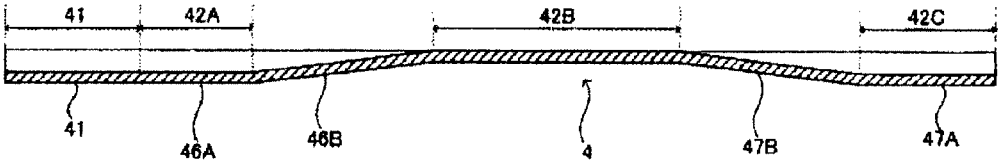
Figure 2C:
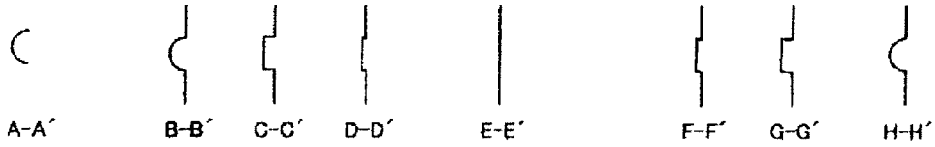

FIGS. 2(*a*) to 2(*c*) each schematically show the metal foil according to the first embodiment of the invention. FIG. 2(*a*) is an enlargement in which the metal foil 4 is viewed from overhead. FIG. 2(*b*) is an enlarged cross section in which the metal foil 4 has been cut in the lengthwise direction to include the center axis. FIG. 2(*c*) is are enlarged cross sections in which the metal foil 4 has been cut in the direction of width which orthogonally intersects the center axis, being taken along lines A-A' to H-H' in FIG. 2(*a*).

As is shown in FIG. 2(*a*), on one end of the metal foil 4, there is a region with a small width 41 which has a groove-like overall shape and a U-shaped cross section. The region with the small width 41 is bordered by a wide region 42 which extends in the lengthwise direction. In the metal foil 4 a region with a small width 41, an end groove 46 which extends over the end of the wide region 42 and in the direction to the base side in the lengthwise direction, and a base-side groove 47 which extends on the base side in the direction to the end in the lengthwise direction are formed. Such an end groove 46 and such a base-side groove 47 are formed beforehand by embossing using a stamping mold such that they are positioned essentially on a straight line.

The depth of the end groove 46, as is shown in FIG. 2(*b*) and FIG. 2(*c*), is identical to that of the region with a small width 41 (see, cross section according to A-A' and cross section according to B-B'). The bottom surface of the region with a small width 41 borders the end of bottom surface 46A which constitutes the bottom surface of an end Ω-region 42A. The bottom 46A is bordered by an end of bevel 46B which is angled such that its depth gradually decreases in the direction to the base of the wide region 42 (see, cross section according to C-C' and cross section according to D-D'). Its depth becomes zero in a region bordering the center, flat region 42B.

The depth of the base-side groove 47, as shown in FIG. 2(*b*) and in FIG. 2(*c*), is uniform (see, cross section according to H-H'). On the base side of the wide region 42, a base-side bottom surface 47A is attached and forms the bottom surface of a base-side Ω-region 42C. Furthermore, a base-side bevel 47B is attached which is angled such that its depth gradually decreases in the direction to the end of the wide region 42 (see, cross section according to G-G' and cross section according to F-F'). Its depth becomes zero in a region bordering the center, flat region 42B.

Because such an end groove 46 and such a base-side groove 47 are attached, for the wide region 42, the end Ω-region 42A with an Ω-shaped cross section borders the region with the small width 41. Furthermore, the middle, flat region 42B is closer to the base side of the wide region 42 than to the end Ω-region 42A and the base-side Ω-region 42C with an Ω-shaped cross section is nearer the base side of the wide region 42 than the middle flat region 42B. This means that, between the end Ω-region 42A and the base-side Ω-region 42C, there is a middle flat region 42B.

Figure 3:
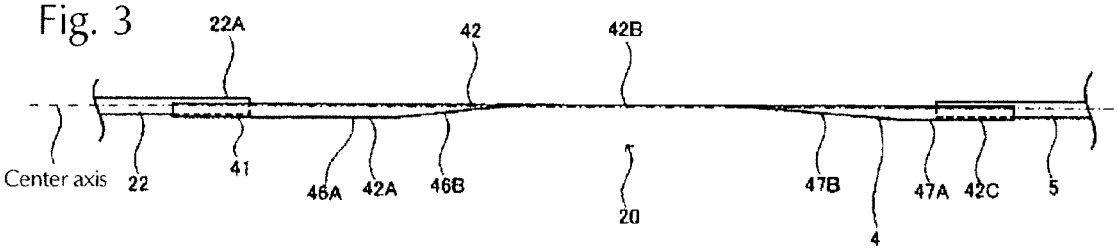
FIG. 3 is a front view of an electrode mounting assembly according to the first embodiment of the invention, in which the upholding part of the electrode and the outer lead are connected to the metal foil.

FIG. 3 is a front view of an electrode mount assembly in accordance with the invention in which the upholding part of the electrode and the outer lead are connected to the metal foil. Because the base part 22A of the upholding part of the electrode 22 is wrapped with a part of the region with a small width 41 with a U-shaped cross section, the electrode 2 is connected to the metal foil 4, the outer lead 5 is connected to the base-side bottom surface 47A of the base-side groove 47, for example, by welding, and thus, the electrode end mount assembly 20 is completed.

In the electrode end mount assembly 20 according to the first embodiment, the outside diameter of the outer lead 5 and the outside diameter of the base part 22A of the upholding part of the electrode 22 are identical to one another. In the electrode end mount assembly 20, the center axis of the base part 22A of the upholding part of the electrode 22 is in the same plane as the flat part 420A in the end Ω-region 42A and the center axis of the outer lead 5 is in the same plane as the flat part 420C of the base-side Ω-region 42C. In this way, the center axis of the base part 22A of the upholding part of the electrode 22 agrees with the center axis of the outer lead 5.

The numerical values of the above described electrode 2, the above described metal foil 4 and the above described outer lead 5 are cited below using one example.

For the upholding part of the electrode 22, the total length in the lengthwise direction which is parallel to the center axis is in the range from 4 mm to 10 mm and the outside diameter of the base part 22A is in the range from 0.3 mm to 0.5 mm.

For the outer lead 5, the total length in the lengthwise direction which is parallel to the center axis is in the range from 30 mm to 50 mm and the outside diameter is in the range from 0.5 mm to 0.8 mm.

For the metal foil 4, the total length is in the range from 14 mm to 21 mm and the thickness is in the range from 0.015 to 0.02 mm. In the region with a small width 41, the total length in the lengthwise direction which is parallel to the center axis is 3 mm and the total length in the direction of width which orthogonally intersects the center axis is in the range from 0.3 mm to 0.6 mm. The weld length of the base part 22A of the electrode in the region with a small width 41 of the metal foil 4 is in the range from 1.3 mm to 1.7 mm. In the wide region 42, the total length in the lengthwise direction which is parallel to the center axis is in the range from 11 mm to 18 mm and the total length of the direction of width which orthogonally intersects the center axis is in the range from 1.2 mm to 1.8 mm.

For the end groove 46, the total length in the lengthwise direction which is parallel to the center axis is in the range from 3 mm to 6 mm and the total length of the direction of width which orthogonally intersects the center axis is in the range from 0.3 mm to 0.6 mm. Furthermore, the total length of the lengthwise direction of the end side bottom surface 46A which forms the bottom surface of the end Ω-region 42A, which lengthwise direction is parallel to the center axis, is in the range from 1 mm to 2 mm and the total length of the lengthwise direction which is parallel to the center axis of the end bevel 46B is in the region from 2 mm to 4 mm.

For the base-side groove 47, the total length of the lengthwise direction which is parallel to the center axis is in the range from 4 mm to 6 mm and the total length in the direction of width which orthogonally intersects the center axis is in the range from 0.3 mm to 0.6 mm. Furthermore, the total length of the lengthwise direction of the end side bottom surface 47A which forms the bottom surface of the end Ω-region 42C, which lengthwise direction is parallel to the center axis, is in the range from 1.7 mm to 2.3 mm and the total length of the lengthwise direction which is parallel to the center axis of the end bevel 47B is in the region from 2 mm to 4 mm. The weld length of the outer lead 5 on the bottom-side bottom surface 47 is in the region from 1.7 to 2.3 mm.

In the middle flat part 42B, the total length in the lengthwise direction parallel to the center axis is in the range from 3 mm to 6 mm.

Second Embodiment

Figure 4A:
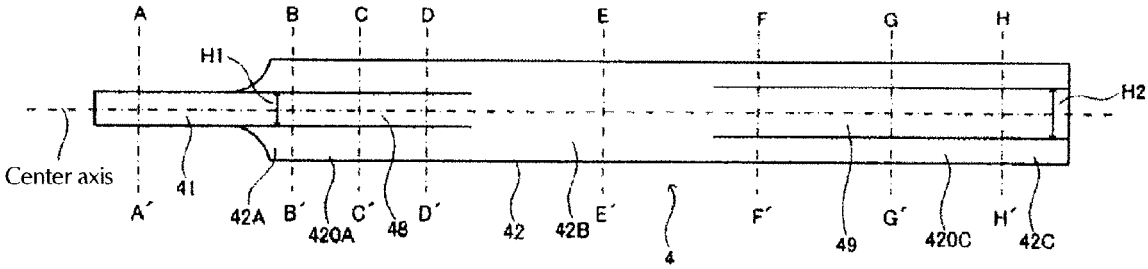
FIGS. 4(*a*) and 4(*b*) are, respectively schematic plan and longitudinal sectional views of the metal foil according to a second embodiment of the invention.
Figure 4B:
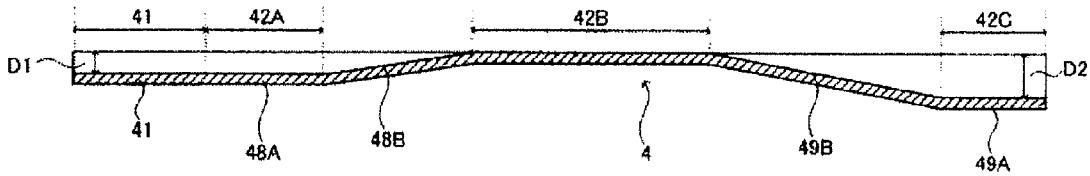
Figure 5:
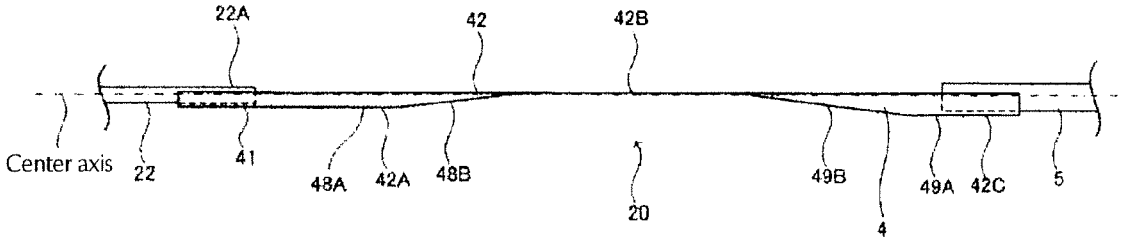
FIG. 5 is a side view of an electrode mount assembly according to the second embodiment of the invention, in which the upholding part of the electrode and the outer lead are connected to the metal foil.

A second embodiment of the ultra high pressure mercury lamp in accordance with the invention is described below. FIGS. 4(*a*) and 4(*b*) each show the metal foil according to the second embodiment of the invention. FIG. 4(*a*) is an enlarged view in which the metal foil 4 is viewed from above. FIG. 4(*b*) is an enlarged cross section in which the metal foil 4 has been cut in the lengthwise direction including the center axis. FIG. 5 is a front view of the electrode end mount assembly according to the second embodiment of the invention. In FIGS. 4(*a*) and 4(*b*) and FIG. 5, the parts labeled with the same reference numbers as in FIGS. 2(*a*) to 2(*c*) and FIG. 3 and therefore, are not further described to the extent have the same structure and function.

In the metal foil 4 shown in FIGS. 4(*a*) and 4(*b*), the width and depth of the base-side groove 49 are greater than the width of the end groove 48. As is shown in FIG. 4(*a*), the value of the width H2 of the base-side groove 49 is greater than the value of the width H1 of the end groove 48. As is shown in FIG. 4(*b*), the value of the depth D2 of the base-side groove 49 is greater than the value of the depth D1 of the end groove 48. As shown in FIG. 5, the upholding part of the electrode 22 is connected to the metal foil 4 by the base part 22A of the upholding part of the electrode 22 being wrapped with part of the region with a small width 41. The outer lead 5 is connected to the metal foil 4 by welding the outer lead 5 on the base-side groove 49. Thus, the electrode end mount assembly 20 is completed.

The ultra high pressure mercury lamp according to the second embodiment of the invention is directed toward the recent trend toward reducing the size of the lamp, and thus, also the size of the electrodes. Furthermore, the electrodes must tightly adjoin the glass of the hermetically sealed portion. If the electrode diameter in the region adjoining the glass is large, the adhesive property on the silica glass is insufficient, so that the construction is such that the outside diameter of the base part 22A of the upholding part of the electrode 22 which is connected to the metal foil 4 is 0.3 to 0.5 mm.

On the other hand, the outer lead 5 constitutes a location which is exposed to the atmosphere. Sufficient mechanical strength must be ensured to prevent its breaking upon oxidation. The outside diameter is therefore 0.5 mm to 0.8 mm. It is generally built such that its diameter is larger than that of the base part 22A of the upholding part of the electrode 22.

The end mount assembly 20 is arranged in the manner described below to bring the center axis of the upholding part of the electrode 22 into agreement with the center axis of the outer lead 5.

For the one-sided groove 48 which extends over the end region with the small width 41 and of the wide region 42, its depth agrees with the radius of the base part 22A of the upholding part of the electrode 22. Furthermore, the depth of the base-side groove 49 agrees with the radius of the outer lead 5 on the base side of the wide region 42.

In the electrode end mount assembly 20 shown in FIG. 5, the center axis of the base part 22A of the upholding part of the electrode 22 is located in the same plane as the flat region 420A of the end Ω-region 42A and the center axis of the outer lead 5 is in the same plane as the flat region 420C of the base side Ω-region.

The action of the above described ultra high pressure mercury lamp is described below using FIGS. 6(*a*), 6(*b*), and FIGS. 7(*a*), 7(*b*).

Figure 6A:
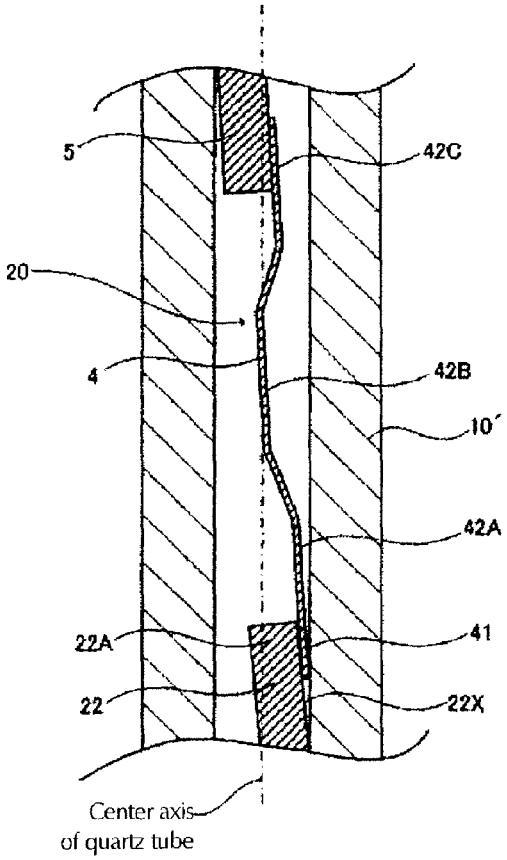
FIGS. 6(*a*) and 6(*b*) each show a schematic of the action of a first embodiment of the invention.
Figure 6B:
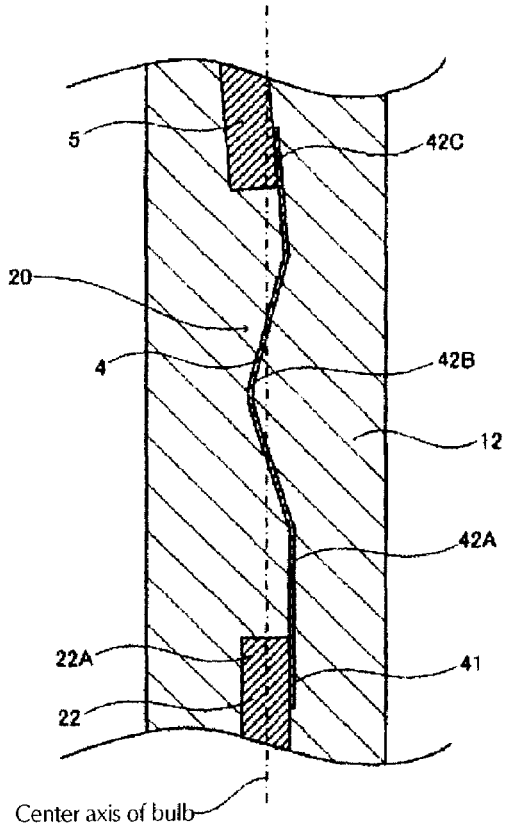

FIGS. 6(*a*) and 6(*b*) each show the action of the first embodiment in which the outside diameter of the outer lead 5 is identical to the outside diameter of the base part 22A of the upholding part of the electrode 22. FIG. 6(*a*) shows the state before hermetic sealing. FIG. 6(*b*) shows the state after hermetic sealing. In FIGS. 6(*a*) and 6(*b*), the connection strip is not shown.

As was described above, when the electrode end mount assembly 20' is inserted into the silica glass tube 10', the electrode mount assembly 20' is angled toward the center axis of the silica glass tube 10', as shown in FIG. 6(*a*). There is the danger that the upholding part of the upholding part of the electrode 22 will be arranged eccentrically from the center axis of the silica glass tube 10'.

By using the metal foil 4 in accordance with the invention, in the above described case of an arrangement of the upholding part of the electrode 22 which is eccentric from the center axis of the silica glass tube 10', it does not happen that the region of the metal foil 4 with a small width 41 is bent. The reason for this is the following:

The middle, flat region 42B is attached in the metal foil 4 in accordance with the invention, by which a load on the surface 22X of the upholding part of the electrode 22 which is adjacent to the silica glass is absorbed in the direction of the center axis of the silica glass tube 10', when this force is applied. In this way, the middle, flat region 42B is bent, by which concentration of the load on the region with a small width 41 is prevented. As is shown in FIG. 6(*b*), bending of the region with a small width 41 is prevented in the metal foil 4. As a result, the adhesive property of the region with a small width 41 in the vicinity of the interior S on the silica glass is ensured so that cracking in the hermetically sealed portion 12 in operation is stopped, as was described above.

The middle, flat region 42B is bent by the above described loading. Since, in the region with the small width 41, in the vicinity of the interior S, the adhesive property on the silica glass is ensured, however, it does not happen that a high mercury vapor pressure in the interior S is acting in operation. Therefore, there is no danger of cracking in the silica glass in the vicinity of the middle, flat region 42B.

Figure 8:
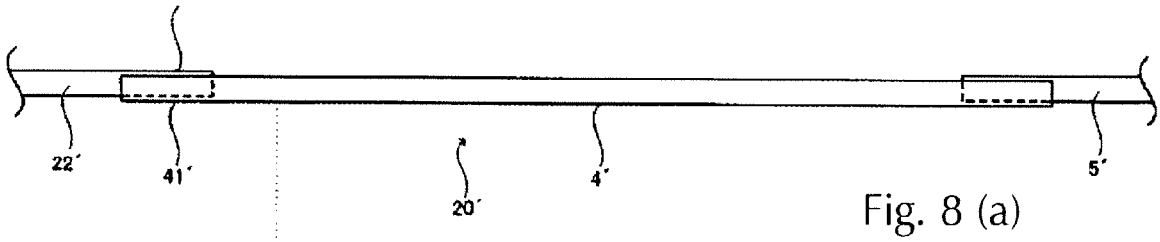
Fig. 8 (a) (Prior Art)
FIGS. 8(*a*) to 8(*c*) each show a schematic of a conventional electrode mount assembly and a conventional metal foil.
Figure 8:
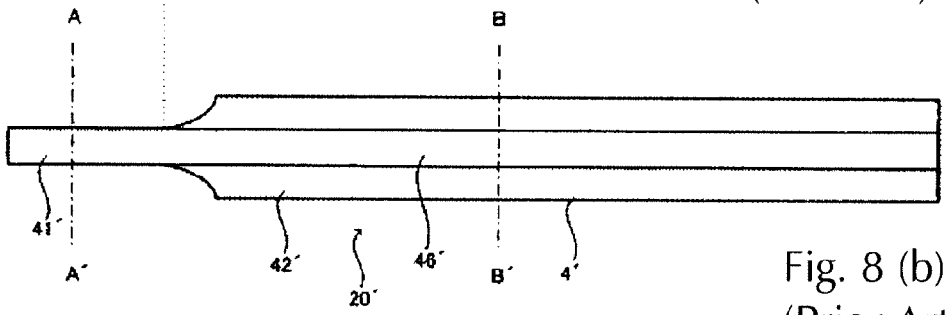
Fig. 8 (b) (Prior Art)
Figure 8:
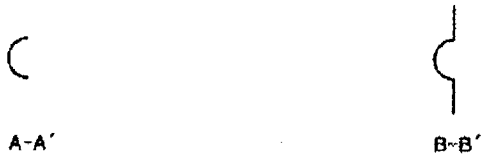
Fig. 8 (c) (Prior Art)
Figure 9:
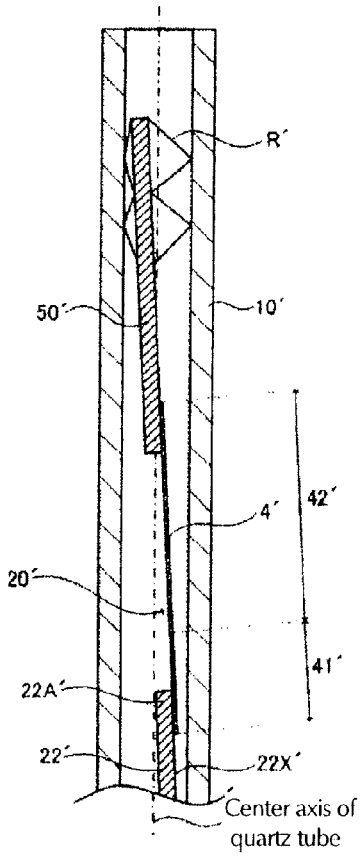
Fig. 9 (a) (Prior Art)
FIGS. 9(*a*) to 9(*c*) each show a schematic illustrating the disadvantage which arises in a conventional ultra high pressure mercury lamp, and FIGS. 10(*a*) and 10(*b*) each show a schematic illustrating the disadvantage which arises in a conventional ultra high pressure mercury lamp.
Figure 9:
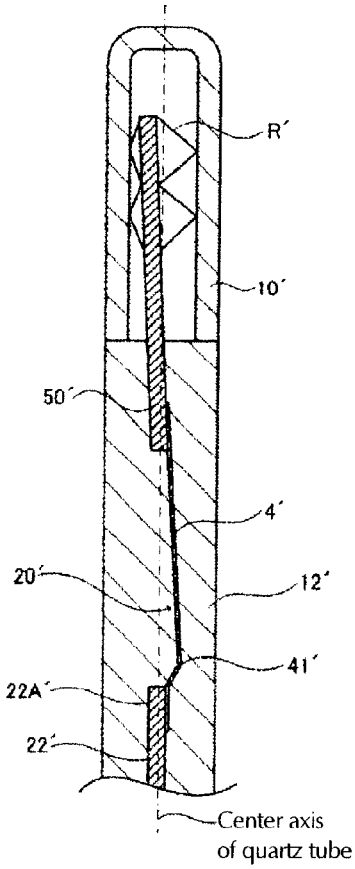
Fig. 9 (b) (Prior Art)
Figure 9:
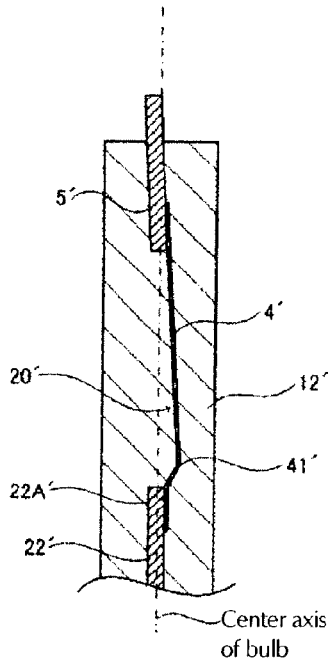
Fig. 9 (c) (Prior Art)
Figure 10:
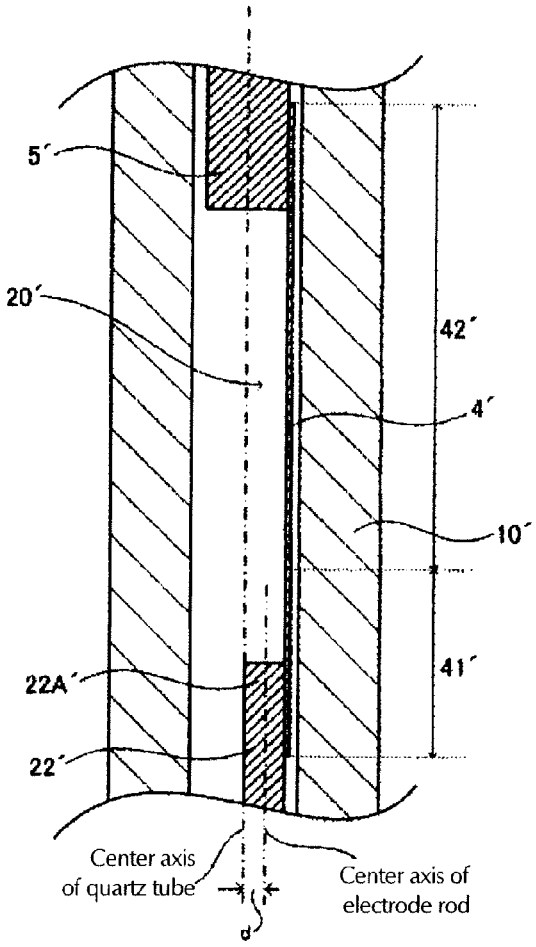
Fig. 10 (a) (Prior Art)
Figure 10:
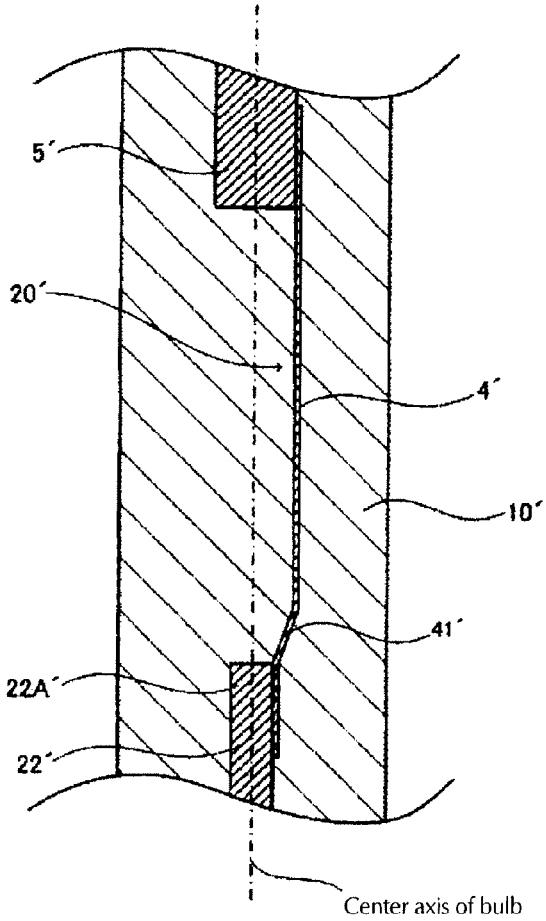
Fig. 10 (b) (Prior Art)

Conversely, if a conventional metal foil with an Ω-cross section is used over the entire length of the wide region 42', as is shown in FIGS. 8(*a*) to 8(*c*), the load, when it is applied to the upholding part of the electrode 22' in the direction of the center axis of the silica glass tube 10', is concentrated on the region with a small width 41', without being absorbed. As a result, the region with the small width 41' is bent. Thus, the adhesive property of the region with a small width 41', which constitutes the vicinity of the interior S, has an adverse affect on the silica glass in its vicinity. As was described above with reference to FIGS. 9(*a*) to 9(*c*), in this way, during operation, a high mercury vapor pressure of the interior S is active, by which cracks form in the hermetically sealed portion 12.

Figure 7A:
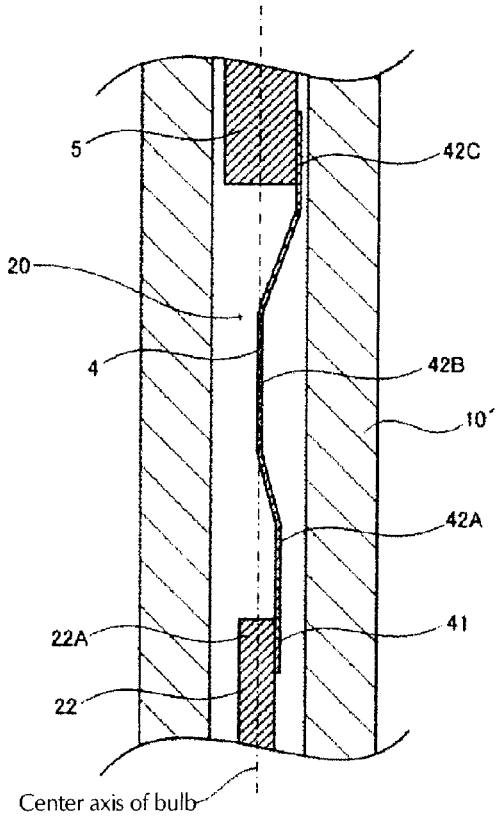
FIGS. 7(*a*) and 7(*b*) each show a schematic of the action of a second embodiment of the invention.
Figure 7B:
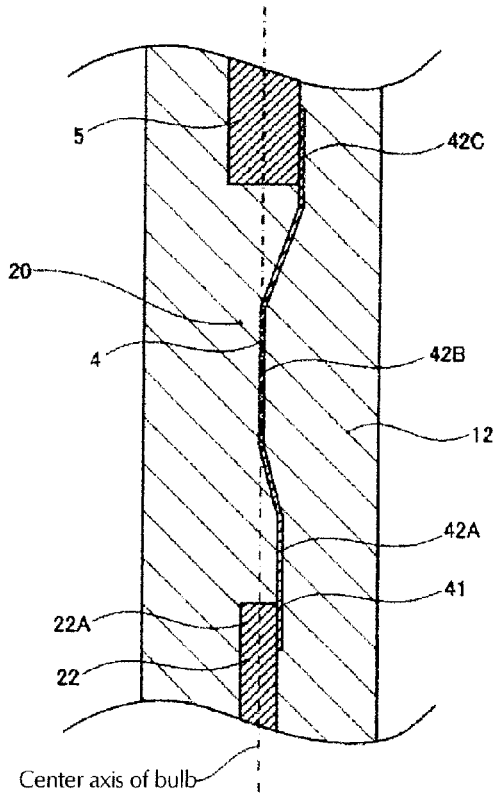

FIGS. 7(*a*) and 7(*b*) each show the second embodiment in which the action is shown in the case in which the outside diameter of the outer lead 5 differs from the outside diameter of the base part 22A of the upholding part of the electrode 22. FIG. 7(*a*) shows the state before hermetic sealing. FIG. 7(*b*) shows the state after hermetic sealing. The connection strip is not shown.

As is shown in FIG. 7(*a*), the electrode mount assembly 20 using the metal foil 4 in accordance with the invention is inserted into the silica glass tube 10' such that the center axis of the outer lead 5 agrees with the center axis of the silica glass tube 10'. As was described above, in the stage of installation of the electrode end mount assembly 20, the center axis of the base part 22A of the electrode 2 agrees with the center axis of the outer lead 5. The base part 22A of the electrode 2 is therefore attached such that its center axis agrees with the center axis of the silica glass tube 10'. It is never attached such that it deviates eccentrically from the center axis of the silica glass tube 10'.

Therefore, for the above described reason, it never happens that for the metal foil 4 is bent to a large extent in the region with the small width 41, as is shown in FIG. 7(*b*). As a result, it is avoided that, in the hermetically sealed portion 12 in the vicinity of the interior S, the adhesive property of the silica glass on the metal foil 4 is adversely affected. Thus, the disadvantage of cracking during operation can be suppressed.

Furthermore, in the case of producing the electrode-mount assembly 20 using the upholding part of the electrode 22 and the outer lead 5 with different outside diameters, the electrode mount assembly 20 is inserted angled relative to the center axis of the silica glass tube 10'. Therefore, there is the danger that the upholding part of the electrode 22 will be arranged eccentrically to the center axis of the silica glass tube 10'. In this case, as was described above, the load which is applied to the upholding part of the electrode 22 to move the upholding part of the electrode 22 in the direction of the center axis of the silica glass tube 10' during shrink sealing is, of course, absorbed by the middle, flat region 42B so that neither bending of the region with a small width 41 of the metal foil 4 nor cracking occurs in the hermetically sealed portion 12.

In the ultra high pressure mercury lamp in accordance with the invention, besides the aforementioned action, the following action can also be obtained.

Since the base part 22A of the upholding part of the electrode 22 is wound with the region with the small width 41 with a U-shaped cross section, between the metal foil 4 and the base part of the upholding part of the electrode 22, there is never a gap. Therefore, cracks in the hermetically sealed portion 12 as a result of the action of a high mercury vapor pressure of the interior S on the gap between the metal foil 4 and the base part 22A of the upholding part of the electrode 22 during operation can be reliably prevented.

Since both the region with a small width 41 and also the base-side Ω-region 42C are attached in the metal foil 4, the upholding part of the electrode 22 and the outer lead 5 can be suitably positioned with respect to the metal foil 4.

In the metal foil 4, the end groove 46 and the base-side groove 47 are formed, for example, by embossing using a stamping die such that they are positioned essentially on a straight line. In this way, the region with a small width 41 with an Ω-shaped cross section and a groove-shaped overall form, and the base-side Ω-region 42C, are formed beforehand. If the upholding part of the electrode 22 and the outer lead 5 are connected to the region with a small width 41 and the base-side Ω-region, and thus, the electrode end mount assembly 20 is formed, the center axis of the base part 22A of the upholding part of the electrode 22 can be brought into agreement with the outer lead 5.

There is the advantage that, by the arrangement of the end Ω-region 42A, the mechanical strength of the metal foil 4 is increased, even if the end Ω-region 42A is not connected to the base part 22A of the upholding part of the electrode 22. In this way, there is no danger that the metal foil 4 will break in transport as compared to a completely flat metal foil, or similar problems. Furthermore, because the shape of the metal foil 4 of the electrode end mount assembly 20 is stably maintained, the electrode end mount assembly 20 is more easily inserted into the silica glass tube 10'.

Furthermore, since the end groove 46 (48) has an end bevel 46B (48B) bordering the end bottom surface 46A (48A), such that it gradually reduces its depth in the direction toward the base side of the wide region 42, the groove depth changes only slowly. The danger of formation of folds in the metal foil 4 during the shrink sealing is thus eliminated. As a result, the adhesive property of the metal foil 4 on the silica glass can be ensured in its vicinity. For the same reason, a base-side bevel 47B borders the base-side groove 47 (49).

In accordance with the invention, it is not necessarily precluded that the middle flat region 42B will border the base side of the end Ω-region 42A or that the middle flat region 42B will border the end side of the base-side Ω-region 42C. It was described above that, in accordance with the invention, the arrangement of the end bevel 46A (48A) in the end groove 46 (48) or the arrangement of the base-side bevel 47A (49A) in the base-side groove 47 (49) is best. However, a configuration is also possible without this.

In the above described embodiment, an ultra high pressure mercury lamp of the alternating current operation type is described. However, the invention can also be used for an ultra high pressure mercury lamp of the direct current operation type. Furthermore, the invention can also be used for a mercury lamp with a smaller amount of added mercury than in the above described ultra high pressure mercury lamp. Also, the invention can be used for other discharge lamps, such as a metal halide lamp and the like with emission substances which do not contain mercury.

What is claimed is:

1. Discharge lamp, comprising:

a light emitting part in which there is a pair of opposed electrodes;

hermetically sealed portions which border the opposite ends of the light emitting part and hermetically seal base parts of the electrodes;

metal foils each of which is installed in a respective one of the hermetically sealed portions and has an end connected to the base part of a respective one of the electrodes;

outer leads, each of which has an end connected to a base part of a respective one of the metal foils and having a base part projecting outward from the respective hermetically sealed portion, wherein the metal foils each have a region with a small width which has a groove-shaped overall configuration with a U-shaped cross section and with which the respective electrode is connected, and of a wide region which borders the region with a small width, and wherein the wide region has:

an end Ω-region which borders a groove of the region with a small width, in which an end groove is formed, and which extends in the lengthwise direction of the metal foil, a base-side Ω-region which is connected to the respective outer lead, in which a base-side groove is formed, and which extends in the lengthwise direction of the metal foil, and a middle, flat region which extends between the end Ω-region and the base-side Ω-region in the lengthwise direction of the metal foil wherein the end groove comprises an end bevel which is angled in a manner gradually reducing the depth thereof in a direction toward the middle, flat region.

2. Discharge lamp in accordance with claim 1, wherein the outside diameter of the electrode and the outside diameter of the outer lead differ from one another, wherein the end groove and the base-side groove each have a width and a depth according to the outside diameter of the base part of the electrode and the outside diameter of the outer lead, and wherein the center axis of the base part of the electrode and the center axis of the outer lead agree with one another in the state connected to the metal foil.

3. Discharge lamp in accordance with claim 2, wherein the outside diameter of the outer lead is larger than the outside diameter of the base part of the electrode.

4. Metal foil for a discharge lamp, comprising:

a region with a small width that has a groove-shaped overall configuration with a U-shaped cross section and a wide region which borders the region with a small width, and wherein the wide region has:

an end Ω-region which borders a groove of the region with a small width, in which an end groove is formed, and which extends in a lengthwise direction of the foil, a base-side Ω-region which is connected to an outer lead, in which a base-side groove is formed and which extends in the lengthwise direction of the foil, and a middle, flat region which extends between the end Ω-region and the base-side Ω-region in the lengthwise direction of the foil wherein the end groove comprises an end bevel which is angled in a manner gradually reducing the depth thereof in a direction toward the middle, flat region, and wherein the base-side groove comprises a base-side bevel which is angled in a manner gradually reducing the depth thereof in a direction toward the middle, flat region.

* * * * *